United States Patent [19]

Alcala

[11] Patent Number: 4,616,429

[45] Date of Patent: Oct. 14, 1986

[54] DISPOSABLE SHOE COVER

[75] Inventor: Robert Alcala, El Paso, Tex.

[73] Assignee: American Hospital Supply Corporation, Evanston, Ill.

[21] Appl. No.: 657,021

[22] Filed: Oct. 2, 1984

[51] Int. Cl.[4] ..... A43B 3/16

[52] U.S. Cl. ..... 36/7.2; 36/7.3; 36/8.3; 36/10

[58] Field of Search ..... 36/7.2, 7.4, 8.3, 7.3, 36/7.1, 9, 10

[56] References Cited

U.S. PATENT DOCUMENTS

| | | | |
|---|---|---|---|
| 1,621,455 | 3/1927 | Bonaventure | 36/8.3 |
| 1,910,251 | 5/1933 | Joha | 36/7.2 |
| 2,171,654 | 9/1939 | Hinchliff et al. | 36/7.2 |
| 2,305,926 | 12/1942 | Kohler | 36/7.3 |
| 2,544,264 | 3/1951 | Howard | 36/7.2 |
| 3,648,109 | 3/1972 | Timg et al. | 36/9 |
| 3,798,503 | 3/1974 | Larsh et al. | 36/9 |
| 3,808,712 | 5/1974 | Elliott | 36/7.3 |
| 4,083,124 | 4/1978 | Michalak | 36/7.1 |
| 4,272,859 | 6/1981 | Vanhove | 36/7.3 |

*Primary Examiner*—Henry S. Jaudon
*Assistant Examiner*—Mary A. Ellis
*Attorney, Agent, or Firm*—Emrich & Dithmar

[57] ABSTRACT

There as disclosed a disposable shoe cover and method of continuously manufacturing the shoe covers from two source rolls of flat, flexible material, producing no scrap.

9 Claims, 14 Drawing Figures

DISPOSABLE SHOE COVER

FIELD OF THE INVENTION

The present invention relates to protective shoe covers such as are used in hospitals or industrial clean rooms to prevent contamination; and more particularly, the invention relates to a novel construction and a method of manufacturing such shoe covers.

BACKGROUND OF THE INVENTION

Shoe covers suitable for use in a sterile environment are known. Further, such shoe covers are known which are inexpensive enough to be considered to be disposable after a single use. However, such prior structures have one or more disadvantages associated with them.

For example, such prior structures in some instances require die cutting of particular shapes incident to manufacture, and this produces scrap and waste, and therefore increases cost. Still other structures require expensive manufacturing techniques such as sewing or the placing of elastic strips along curved or complex paths thereby complicating the manufacturing apparatus. Still others require that the covers be manufactured as discreet articles.

SUMMARY OF THE PRESENT INVENTION

The present invention is directed to a disposable shoe cover which is manufactured continuously from two source rolls of flat, flexible material and produces no scrap. Thus, the manufacturing process can take advantage of rotary machines for handling and processing webs at high speeds such as already exist in other industries.

In the structure of the cover, the sides of the shoe cover are formed from originally flat, and generally rectangular panels secured together along their bottom edges with a piece of stretched elastic strip by hot melt adhesive. Similarly, pieces of stretched elastic strip are affixed to the upper edges of the panels, preferably in pockets formed by folding the upper edges on themselves to cover the elastic strips. The forward portion of the upper edges of the panels are adhesively secured together to form a seam over the toe portion of the shoe, the rear portion of the upper edges remaining unattached to provide an access opening in the cover. The forward and rear edges of the panels are also adhesively secured together.

In use, the elastic strips gather the upper and lower edges of the panels to conform to a wide range of shoe sizes while achieving a snug fit.

In the manufacturing process the webs are continuously fed together in facing, overlapping, contacting relation. Prior to bringing the web into engagement, corresponding edges are folded over to form pockets and strips of stretched elastic are fed respectively into these pockets and secured within the pockets by continuously applied hot melt adhesive. A third strip of stretched elastic is continuously fed between the webs adjacent to the other edges of the webs which are also coated with a strip of hot melt adhesive.

Another adhesive applicator is programmed in synchronism with a rotating cutting knife to apply adhesive to a portion of the inner surface of what will become the upper edges of the cover to form the toe seam.

Another glue applicator provides a first transverse glue strip to one of the webs to form the heel seam of the product, and immediately thereafter, the same applicator applies a second transverse strip of adhesive to form the front seam of the next following cover. The knife is located on a rotating roll to severe the webs between the two adjacent transverse glue strips.

Thus, disposable shoe covers are continuously formed at relatively high speeds by rotating equipment, and the seams are formed by hot melt adhesive, thereby eliminating any scrap and obviating the need for curved configurations of seams or gathering strips and eliminating expensive processes such as sewing.

Other features and advantages of the present invention will be apparent to persons skilled in the art from the following detailed description of the invention accompanied by the attached drawing.

DESCRIPTION OF PREFERRED EMBODIMENTS

Figure 1:
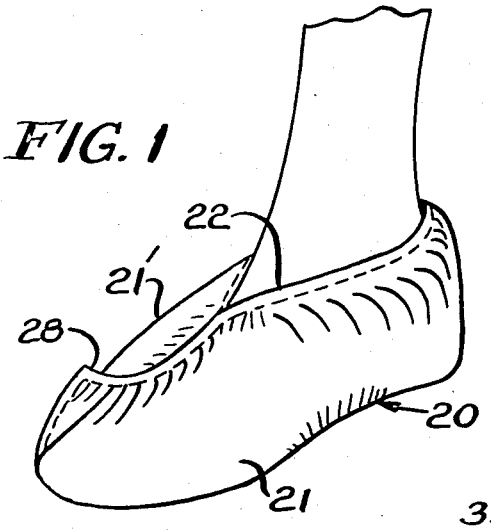
FIG. 1 is an upper frontal perspective view of a protective shoe covering incorporating the present invention and in use.

Referring to FIGS. 1–4, there is illustrated a disposable shoe cover indicated generally at 20 which is intended to provide protection to sterile environments such as hospital operating rooms, laboratories, biological clean rooms, industrial clean rooms and the like.

The shoe cover 20 is constructed from two originally flat panels 21 and 21' formed from respective continuous flexible webs which form left and right half portions. The panels are glued together along the edges thereof to form a shoe-shaped enclosure with an opening 22 for receiving the shoe of a wearer. Portions of panel 21' which correspond to those of panel 21 have been given the same reference number but with a prime notation. As will be described in more detail hereinafter, the shoe covers 20 are produced from continuous running webs of material which are severed between products after the right and left half portions of the shoe covers have been formed and assembled together.

Figure 4:
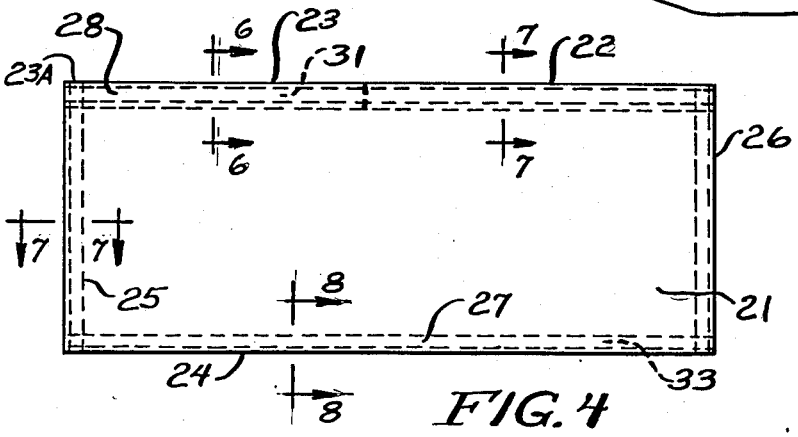
FIG. 4 is a side elevational view of the shoe cover in a stretched condition to illustrate the shape of the flexible members which form the shoe cover.

Referring to FIG. 4, which illustrates the shoe cover 20 in a stretched condition (i.e. prior to release from the manufacturing apparatus, as will be understood from following description), each panel of the shoe cover 20, such as the left half panel 21, is originally rectangular in shape having an upper edge 23, a lower edge 24 and front and rear edges 25 and 26. In one shoe cover produced in accordance with the teachings of the invention, the panels are 16.5 inches long and 7 inches wide (or high) in the stretched condition. One material suitable for use as the base web for the shoe cover is material sold under the trademark TYVEK. However, other materials such as scrim reinforced nonwoven, spun bonded polypropylene or any other material capable of being secured by adhesive is also suitable for use as the base web.

The two panels 21 and 21' are continuously joined together by adhesive along the entire extent of their lower edge 24, and front and rear edges 25, 26 and along the forward portion 23A of the upper edge. In accordance with one aspect of the invention, a process for producing the shoe covers 20 includes joining the two panels 21 and 21' together using a hot melt adhesive applied to the panels in continuous strips as will be described hereinbelow.

Figure 3:
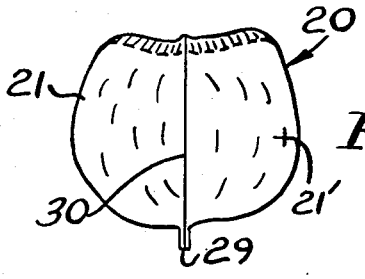
FIG. 3 is a rear elevational view showing the heel portion of the shoe cover.
Figure 2:
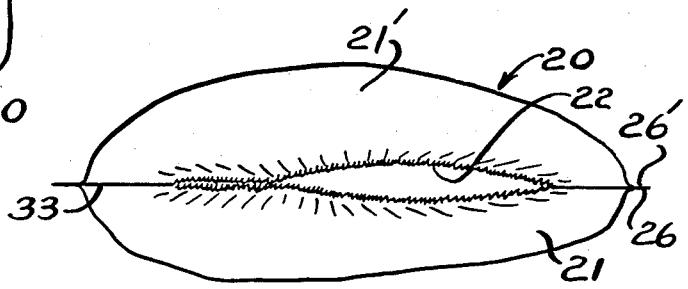
FIG. 2 is a plan view of the shoe cover of FIG. 1.

Referring to FIGS. 1–3, the hot melt adhesive joint thus provides a continuous seam having a toe seam portion 28, a sole seam portion 29 and a heel seam portion 30. The heel seam portion 30 (FIG. 3) extends in an upward direction from the sole seam portion 29 completely up the heel. The toe seam portion 28 extends from the sole seam portion 29 in an upward direction and ends at the opening 22. Elastic is provided around the opening 22 and in the toe seam portion 28 and the sole seam portion 29 to keep the shoe cover in place snuggly on the wearer's footwear thereby to enable the shoe cover to fit a wide range of shoe sizes and styles.

Referring to FIGS. 4–8, a first strand of elastic 31 is attached to the panel 21 within a folded portion near its upper edge 23, and extends the entire length of the panel 21. A second strand of elastic 32 is similarly attached to the panel 21' near its upper edge 23' and extends the entire length of the panel 21'. A third strand of elastic 33 is attached beneath a fold in the sole seam portion 29, extending along the entire length of the sole seam portion.

The elastic strand 31 is glued to the inner surface 36 of panel 21. The upper edge 23 of panel 21 is folded inward over the elastic strand 31, and glued to inner surface 36 defining a pocket 37 extending the entire length of panel 21 in which the elastic strand 31 is contained. Similarly, the upper edge 23' of panel 21' is folded inward over elastic strand 32, which is glued to the inner surface 36' of panel 21' defining a pocket 37' extending the entire length of panel 21' which contains the elastic strand 32.

Figure 5:
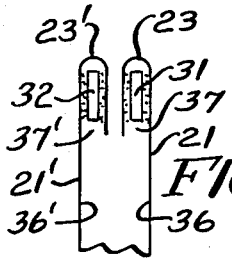
Figure 6:
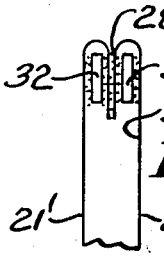

Abutting surfacing inner surfaces of the folded upper edges of panels 21 and 21' are glued together (FIG. 6) to form the toe seam 28 forward of the edge opening 22 (FIG. 1). The folded edges are not joined in the rear portion of the shoe cover, as shown in FIG. 5, to define the opening 22. The two elastic strands 31 and 32 which extend across the top of the shoe cover 20 provide stretch for the opening 22 as well as for the front portion of the opening 22 to the toe area of the shoe cover 20.

Figure 8:
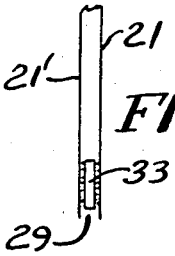

As shown in FIG. 8, the elastic strand 33 is glued in place between the bottom edges of the members 21 and 21' which are glued together to define the sole seam portion 29. The strip of elastic 33 pulls the heel and toe portions of the shoe covering 20 toward each other to conform to a wide range of shoe sizes and retain the covering on the foot.

Figure 7:
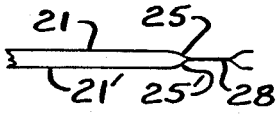
FIGS. 5–8 are fragmentary sectional views taken along the respective sight lines of FIG. 4.

Referring to FIG. 7, forward edges 25, 25' of the panels 21 and 21' are glued together to define the forward portion of the toe seam 28. The rear edges 26, 26' are also glued together to define the heel seam portion 30. The elastic strands 31–33 are stretched and maintained in tension while they are being applied. When the tension is released, the elastic strands 31–33 on the top and bottom cause the flexible material of panels 21 and 21' to gather along the length of the strands.

Figure 9:
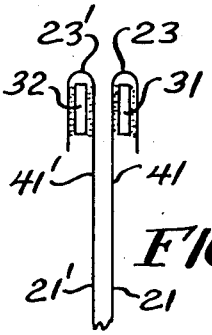
FIG. 9 is a fragmentary vertical sectional view of the upper rear portion of an alternate embodiment of the shoe cover, in the proximity of the opening.
Figure 10:
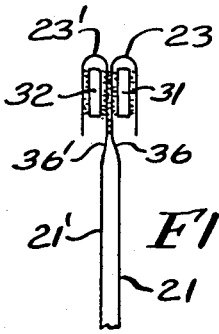
FIG. 10 is a fragmentary sectional view of the toe seam portion of the alternate embodiment of the shoe cover.
Figure 11:
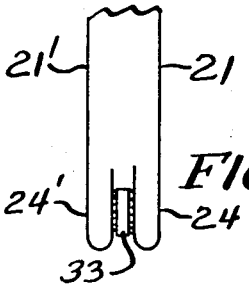
FIG. 11 is a fragmentary sectional view of the sole seam portion of the alternate embodiment of the shoe cover.

Referring to an alternate construction of FIGS. 9–11, the upper edges 23 and 23' of the panels 21 and 21' may be folded outwardly as illustrated. In this embodiment, the elastic strands 31 and 32 are attached to the outer surfaces 41 and 41' of the panels 21 and 21' which are then folded outwardly over the elastic strands 31 and 32 to define a pocket for receiving the elastic strands. In addition, the inner surfaces 36 and 36' of the panels 21 and 21' are glued together in the forward portion of the shoe cover 20 to define the toe seam portion 28. Further, as illustrated in FIG. 11, the bottom edges 24 and 24' of the panels 21 and 21' may be folded inwardly with the elastic strand 33 glued in place between the two folded edges to form the sole seam portion 29. With this embodiment, the shoe cover is turned inside out after the panels have been secured together.

In accordance with another aspect of the invention, there is provided a novel process for making shoe covers in which the shoe covers are produced from a continuous running length of material which is severed between products after the shoe covers have been assembled. The novel shoe cover pattern does not generate any scrap material since the shoe cover shape is specifically designed to provide 100% material usage. Moreover, the elastic strands 31–33 are secured continuously to the panels 21 and 21' by means of hot melt strips which are applied automatically and in a continuous manner. Finally, the webbed panel material as well as the elastic strands are cut simultaneously after the forming and gluing operations have been completed.

Figures 11A, 12, 12A:
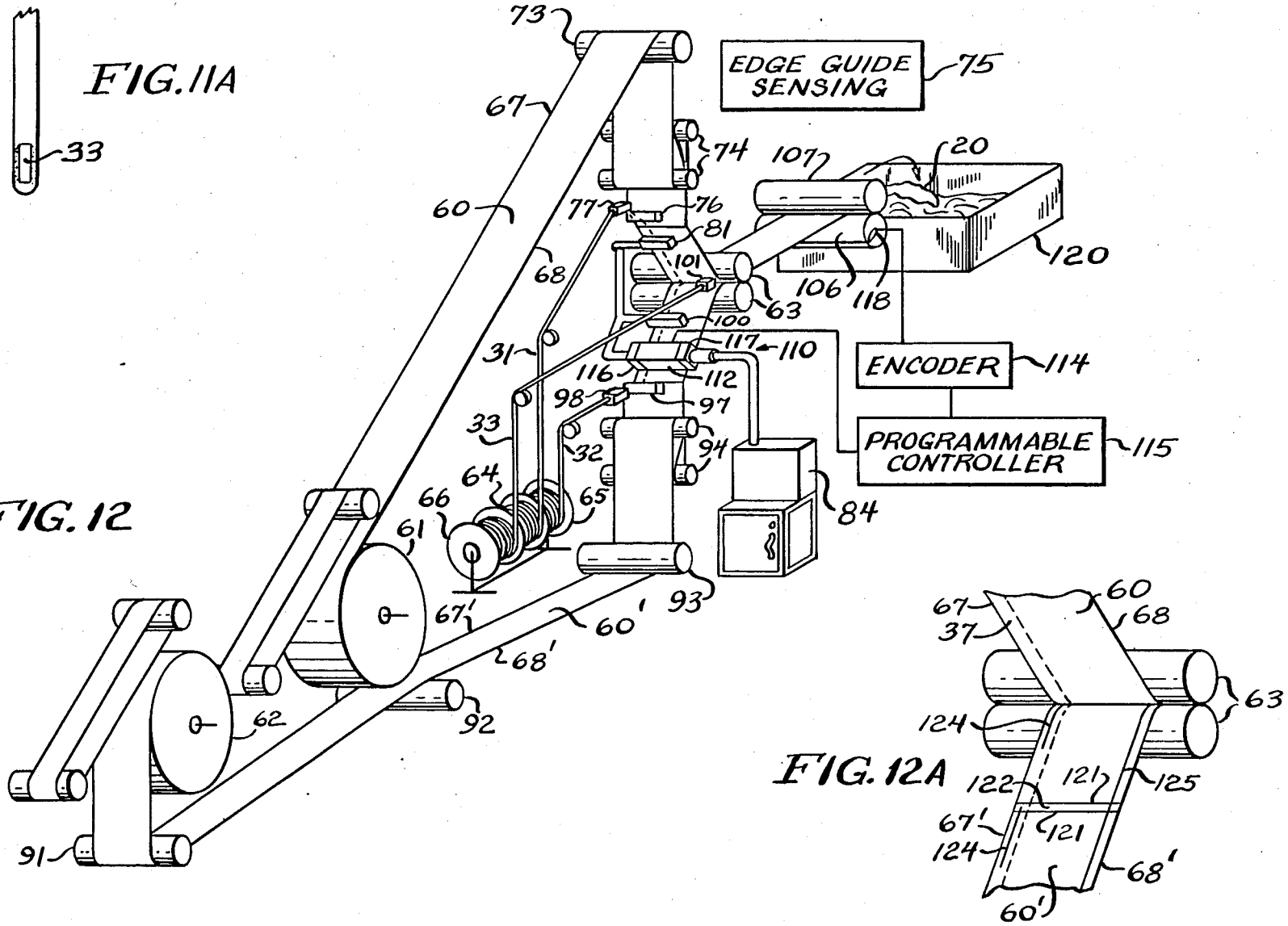
FIG. 12 is a diagrammatic perspective view of apparatus for producing the shoe cover of the present invention.
FIG. 12A is a close up view of the side webs of the shoe cover as they enter the chill rolls of FIG. 12.

Turning now to the novel process for manufacturing the shoe cover 20 provided in accordance with the present invention, the apparatus for forming the shoe covers in a continuous operation is illustrated in FIG. 12.

Referring to FIG. 12, apparatus is diagrammatically illustrated which produces the shoe covers 20 of the present invention. The base web material 60 and 60' which form the panels 21 and 21' of the shoe cover 20 are fed to the apparatus continuously through upper and lower portions of the apparatus from a pair of belt-driven supply rolls 61 and 62, and drawn through the apparatus by nip rolls 63. The elastic stands 31–33 are fed to the apparatus continuously from elastic unwinds 64, 65, and 66 respectively.

The continuous web 60 from which the panel 21 is formed is fed to the upper portion of the apparatus over guide roll 73 and directed down to an edge guide system including further guide rolls 74 and an electronic sensing apparatus 75 of the type known in the art for maintaining the continuous web centered on the rolls as it is fed through the apparatus. The edge guide system thus assures that the edges of webs 60 and 60' will be aligned.

The base web material 60 is drawn by nip rolls 63 from guide rolls 74 over an edge folding board 76. The edge folding board 76 folds over a ½ inch strip of the upper edge 67 of the base web material 60, which appears on the left hand edge in FIG. 12, producing continuous pocket 37 which receives the elastic strand 31 on the surface 36 which will be the inner surface of the finished shoe cover 20 (FIG. 5).

The elastic strand 31 is applied to the base web 60 under tension by a conventional elastic applicator apparatus 77 which is located just ahead of the folding board 76. Elastic applicator apparatus 77 may take the form of two pairs of spaced rolls which are rotating at different speeds. The pair adjacent the source rotate at a slower rate than the pull rolls through which the stretched strand is metered to the web. To adjust the tension on the elastic strand, the input rolls are either slowed down (to increase tension) or the output metering rolls are sped up. The elastic applicator apparatus 77 applies the elastic strand 31 to the web 60 automatically and continuously in a stretched form, locating the elastic strand 31 within the pocket 37 formed by the folded over edge of the continuous web 60.

For the purpose of glueing the elastic strand 31 to the base web and glueing the folded over edge 67 of the base web, as the web 60 is advanced towards the nip rolls, hot melt adhesive from a reservoir 84 is applied to the surface of the base web 60 through a nozzle 81. The hot melt adhesive is pumped to the nozzle 81 and is applied to the surface 36 of the base web 60 in a continuous bead or strip beneath the folded edge 67 of the base web 60 which covers the elastic strand 31.

The second base web 60' is similarly processed simultaneously with the above operations for base web 60, the base web material 60' is fed through the bottom portion of the apparatus from its supply roll 62 and directed down and around guide roll 91, over guide roll 92 and thence upward around guide roll 93. The base web 60' is then fed through an edge guide system including guide rolls 94 which are controlled by the previously referenced sensing apparatus 75.

The base web material 60' is then directed to edge folding board 97 which continuously folds over a ½ inch portion of the upper edge 67' of the base web 60' to define pocket 37' which receives elastic strand 32.

The elastic strand 32 is applied under tension to the base web 60' by elastic applicator apparatus 98 which is located just ahead of the edge folding board 97 and may be similar to the elastic applicator apparatus 77 described above. Hot melt adhesive from the reservoir 84 is applied to the base web 60' through nozzle 100 for glueing the adhesive strand 32 to base web 60' and for glueing the folded over edge to inner surface 36'.

As the two base webs 60 and 60' are directed toward the nip rolls 63, the web 60 is brought into face contact with web 60' with the edges 67, 67' aligned and, the edges 68, 68' aligned.

An adhesive application control apparatus 110 applies hot melt adhesive transversely along the inner surface 37' of the lower base web 60' for providing the front and rear transverse seams of the cover. In addition, the adhesive application control apparatus 110 also applies a continuous strip of hot melt adhesive along the bottom edge 68' to provide bottom seam portion 29, and provides a strip of hot melt adhesive, intermittantly along the top edge 67' to provide the toe seam portion 28 and define the opening 22.

With references to FIGS. 12 and 12A, the apparatus 110 includes a nozzle 112 which, by way of example only, may have a seven inch slit discharge opening which extends transversely of the web 60'. A solenoid actuated valve (not shown) is operable to control the flow of hot melt adhesive supplied thereto from the pressurized reservoir 84 to the nozzle 112 under the control of a programmable controller 115. The adhesive application control apparatus 110 applies two parallel strips 121 of hot melt adhesive, the space 122 between the two adhesive strips defining a line of separation between two adjacent shoe covers in the continuous web.

For the purpose of synchronizing the operation of the control apparatus 110, an encoder 114 associated with the shaft of the cutting roller 106 and provides an output for the programmable controller 115 enabling it to selectively actuate the solenoid valve associated with nozzle 112 once or more during each revolution of the shaft 118 of the cutting roller 106 and at a predetermined angular displacement of that shaft so that the glue is deposited at the desired place. The programmable controller 115 controls the glue application, starting and stopping the glue flow as programmed by the user.

The apparatus 110 includes a further nozzle 116 having an associated solenoid operated valve, located near the left hand edge of the base web 60', and is operated by the programmable controller 115 to be energized for one major portion of a revolution (approximately one-half) of the cutting roller 106 and to be deenergized for the remainder of that revolution. Accordingly, a strip 124 of hot melt adhesive is applied along a portion of the continuous web 60' corresponding to approximately one-half the length of a final shoe cover product. The glue strip provides the toe seam 23A and defines the opening 22 in the top of the final shoe cover product.

The third strand of elastic 33 is applied between the two continuous webs 60 and 60' just prior to their passing between the nip rolls 63. To this end, a further elastic applicator apparatus 101 is provided to direct the elastic strand 33 from the elastic unwind 66 to the inner surface of the web 60' near its bottom edge. The elastic applicator apparatus 101 includes a pair of tension rollers (not shown) rotating at a speed slower than that of the nip rolls 63 so that the elastic strand 33 is maintained tensioned as it is applied to the web 60'. The elastic strand 33 is secured to the web 60' by hot melt adhesive applied in a continuous strip 125 along the bottom edge 68' of the web 60' through nozzle 117 of the adhesive application control apparatus 110 for glueing together the edges of the webs 60, 60' which define the sole seam portion 29 of the final product.

The hot melt adhesive applied to the continuous webs 60 and 60' is set as the two webs pass between the pull rolls 63 which serve as chill rolls.

The continuous length of serially interconnected shoe covers is fed between cutting roller 106 and anvil roller 107 where the continuous material is severed between products. When the shoe cover web is being cut into separate shoe covers 20, the web material as well as the elastic strips 31–33 are cut. The individual shoe covers 20, thus formed, may be accumulated in a suitable bin 120 for packaging.

Having thus dislocated alternate embodiments of a novel product, as well as a method of continuously forming such product, persons skilled in the art will be able to modify certain of the steps disclosed and to substitute equivalent elements for those illustrated while continuing to practice the principle of the invention; and it is thus intended that all such modifications and substitutions be covered as they are embraced within the spirit and scope of the appended claims.

An example of a possible modification would be the use of a single web instead of two webs 60 and 60'. The single web would have twice the width of 60 or 60'. A stretched elastic member 33 would be secured to the center of the web by means of an adhesive. Then the web is folded in half as shown in FIG. 11A. This process is continuous.

I claim:

1. A disposable shoe cover adapted to fit shoes over a range of sizes comprising:

first and second originally separate flat and generally rectangular panels of flexible sheet material, each defining top, bottom, front and rear edges, the edges of said panels being aligned;

first and second adhesive means securing the front and rear edges, respectively of said panels continuously together;

first and second strips of elastic material;

third and fourth adhesive means for fixing said first and second strips of elastic material in stretched condition to said top edges respectively of said first and second panels with said first and second strips of elastic material extending along substantially the entire length of the edge to which it is fixed;

a third strip of elastic material;

fifth adhesive means for fixing said third strip of elastic material in stretched condition to said bottom edges of said panels and for securing said bottom edges of said panels together;

and sixth adhesive means for connecting a portion only of said top edges of said panels together and extending from the front edge of said cover to provide an access opening adjacent to the rear of said cover.

2. The article of claim 1, wherein said fifth adhesive means secures adjacent surfaces of said bottom edges together to said third adhesive strip and a sole seam said panels inside out.

3. The shoe cover of claim 1, wherein the upper edge of said first panel is folded over in itself defining a first pocket which extends along the entire length of said first panel, and the upper edge of said second panel is folded over on itself defining a second poket which extends along the entire length of said second panel.

4. The shoe cover of claim 3, wherein said first and second strips of elastic material are contained within said first and second pockets respectively.

5. The article of claim 3, wherein said pockets formed at the upper edges of said first and second panels are characterized in that the free upper edges of said panels are folded toward one another so that their respective facing surfaces engage and are adhesively fastened together over a portion thereof.

6. The article of claim 1, wherein the upper edges of said first and second panels are folded outwardly to form said pockets and adhesively secured along a portion of the inner surfaces thereof, the upper toe seam of said cover being formed by turning the cover inside out.

7. A disposable shoe cover adapted to fit shoes over a range of sizes comprising:

first and second originally flat and generally rectangular panels of flexible sheet material, each defining top, bottom, the front and rear edges, and the panels being joined together integrally along this bottom edge;

the edges of said panels being aligned;

first and second adhesive means securing the front and rear edges, respectively, of said panels continuously together;

first and second strips of elastic material;

third and fourth adhesive means for fixing said first and second strips of elastic material, respectively, in stretched condition to said top edges respectively of sadi first and second panels with said first and second strips of elastic material extending along substantially the entire length of the edge to which it is fixed;

a third strip of elastic material;

fifth adhesive means for fixing said third strip of elastic material in stretched condition to said bottom edges of said panels;

and sixth adhesive means for connecting a portion only of said top edges of said panels together and extending from the front edge of said cover to provide an access opening adjacent to the rear of said cover.

8. A disposable shoe cover adapted to fit shoes over a range of sizes comprising:

first and second originally separate flat and generally rectangular panels of flexible sheet material, each defining top, bottom, front and rear edges, the edges of said panels being aligned;

means securing the front edges of said panels continuously together;

means securing the rear edges of said panels together;

first and second strips of elastic material;

means fixing said first strip of elastic material in stretched condition to said top edge of said first panel, and means fixing said second strip of elastic material in stretched condition to said top edge of said second panel, said first and second strips of elastic material extending along substantially the entire length of the edge to which it is fixed;

a third strip of elastic material;

means fixing said third strip of elastic material in stretched condition to said bottom edges of said panels and securing said bottom edges of said panels together;

and means connecting a portion only of said top edges of said panels together and extending from the front edge of said cover to provide an access opening adjacent to the rear of said cover.

9. A disposable shoe cover adapted to fit shoes over a range of sizes comprising:

first and second originally flat and generally rectangular panels of flexible sheet material, each defining top, bottom, the front and rear edges, and the panels being joined together integrally along this bottom edge;

the edges of said panels being aligned with the front and rear edges of said panels being secured together;

first and second strips of elastic material;

said first and second strips of elastic material fixed in stretched condition to said top edges respectively of said first and second panels and extending along substantially the entire length of the edge of which it is fixed;

a third strip of elastic material;

means fixing said third strip of elastic material in stretched condition to said bottom edges of said panels;

and means connecting a portion only of said top edges of said panels together and extending from the front edge of said cover to provide an access opening adjacent to the rear of said cover.

* * * * *

UNITED STATES PATENT AND TRADEMARK OFFICE

CERTIFICATE OF CORRECTION

PATENT NO. : 4,616,429

DATED : October 14, 1986

INVENTOR(S) : Robert Alcala

It is certified that error appears in the above-identified patent and that said Letters Patent is hereby corrected as shown below:

IN THE SPECIFICATION

Col. 2, after the description of FIG. 11 (line 38) insert:

-- FIG. 11 A is a fragmentary section view of an alternate construction of the shoe cover; --;

Col. 4, line 52, correct "stands" to --strands--;

IN THE CLAIMS

Claim 2 (Col. 7, lines 34-5) delete "said panels inside out";

Claim 3 (Col. 7, line 40), correct "poket" to --pocket--; and

Claim 7 (Col. 8, line 4), correct "sadi" to --said--.

Signed and Sealed this

Twenty-third Day of February, 1988

*Attest:*

DONALD J. QUIGG

*Attesting Officer*

*Commissioner of Patents and Trademarks*